United States Patent [19]

Democh

[11] 4,051,278

[45] Sept. 27, 1977

[54] METHOD FOR REDUCING MOTTLE IN COATING A SUPPORT WITH A LIQUID COATING COMPOSITION

[75] Inventor: Roger E. Democh, Rochester, N.Y.

[73] Assignee: Eastman Kodak Company, Rochester, N.Y.

[21] Appl. No.: 584,322

[22] Filed: June 6, 1975

[51] Int. Cl.[2] ..... B05D 3/00; B05D 3/04

[52] U.S. Cl. ..... 427/326; 427/262; 427/280; 427/322; 427/374 A; 427/374 R; 96/87 R; 96/94 R; 118/59; 118/68; 118/69

[58] Field of Search ..... 427/374, 398, 322, 398 A, 427/398 C, 398 D, 398 R, 374 R, 262, 280, 326, 374 A; 118/69, 59; 96/87 R, 94 R

[56] References Cited

U.S. PATENT DOCUMENTS

| | | | |
|---|---|---|---|
| 1,829,153 | 10/1931 | Pearl | 118/69 X |
| 1,851,509 | 3/1932 | Hampton | 427/398 X |
| 2,269,169 | 1/1942 | Derhoef et al. | 96/94 R |
| 2,795,522 | 6/1957 | Johns | 156/244 |
| 2,808,340 | 10/1957 | Learn | 427/316 |
| 2,815,307 | 12/1957 | Beck | 156/244 |
| 3,067,056 | 12/1962 | Remer | 427/152 |
| 3,082,144 | 3/1963 | Haley | 156/244 |
| 3,395,034 | 7/1968 | Przybilla | 96/87 R |

FOREIGN PATENT DOCUMENTS

| | | | |
|---|---|---|---|
| 752,333 | 2/1967 | Canada | 117/102 |

*Primary Examiner*—Ronald H. Smith
*Assistant Examiner*—Evan K. Lawrence
*Attorney, Agent, or Firm*—A. P. Lorenzo

[57] ABSTRACT

In coating a support, such as a flexible web of synthetic organic polymer, with a coating composition comprising a film-forming material in an evaporable liquid vehicle, at least two of (1) the temperature of the atmosphere in the coating zone, (2) the temperature of the coating composition at the point where it is coated on the support, and (3) the temperature of the support at the point where the coating composition is applied thereto, are maintained at a temperature substantially equivalent to the equilibrium surface temperature of the coated layer within the coating zone. The equilibrium surface temperature is defined as the temperature assumed by the surface of a layer of the coating composition under steady state conditions of heat transfer following evaporative cooling of the layer in the coating zone. Such temperature control minimizes thermal gradients within the coated layer and significantly reduces the formation of mottle and similar coating defects. The method is especially useful in the coating of organic solvent solutions of polymeric resins and finds particular application in the manufacture of photographic elements.

16 Claims, 2 Drawing Figures

METHOD FOR REDUCING MOTTLE IN COATING A SUPPORT WITH A LIQUID COATING COMPOSITION

BACKGROUND OF THE INVENTION

1. Field of the Invention

This invention relates in general to the coating art and in particular to the coating of supports with liquid coating compositions. More specifically, this invention relates to an improved method of coating sheet materials, such as webs composed of synthetic organic polymers or of polymer-coated paper, with coating compositions comprising a film-forming material in a liquid vehicle, whereby the formation of mottle in the coated layer is reduced.

2. Description of the Prior Art

Formation of mottle in the coating of supports with liquid coating compositions is a very common problem which is encountered under a variety of circumstances in the coating arts. For example, coating compositions consisting of solutions of a polymeric resin in an organic solvent are frequently coated in layer form onto sheet materials, such as webs of synthetic organic plastic material. Mottle, or non-uniform density, is an especially severe problem when the coating solvent is a volatile organic solvent but can occur to a significant extent even with aqueous coating compositions or with coating compositions utilizing an organic solvent of low volatility. The mottle is an undesirable defect in some instances because it detracts from the appearance of the finished product and in some instances, such as in the photographic art, it is also undesirable because it adversely affects the functioning of the coated article. Various expedients have been employed heretofore in an effort to eliminate, or at least minimize, the formation of mottle in coated layers. For example, surfactants are often added to the coating compositions as described, for example, in U.S. Pat. No. 3,514,293. These are sometimes effective in reducing mottle but in many cases the degree to which mottle forms is still excessive in spite of the inclusion of a surfactant in the coating composition. It is believed that there are a variety of factors which can contribute to the formation of mottle and the exact mechanism of its formation is not well understood. Regardless of the specific causes of mottle, its formation in coated layers, as well as the occurrence of other defects such as streaks and lines, is a long standing problem of serious concern in the manufacture of coated materials, and especially in the manufacture of photographic products.

SUMMARY OF THE INVENTION

It has now been discovered that a reduction in the degree to which mottle is formed in coated layers formed from a coating composition comprising a film-forming material in an evaporable liquid vehicle can be achieved by the use of an improved coating process in which the temperature of the support being coated, the temperature of the coating composition, and the temperature of the atmosphere within the coating zone are controlled. More particularly, it has been unexpectedly found that when at least two and preferably all three of (1) the temperature of the atmosphere in the coating zone, (2) the temperature of the coating composition at the point where it is coated on the support, and (3) the temperature of the support at the point where the coating composition is applied thereto, are maintained at a temperature substantially equivalent to the equilibrium surface temperature of the coated layer within the coating zone, then the formation of mottle in the coated layer is significantly reduced as compared with coating under conditions where these temperatures are not controlled in this manner. As used herein, the term "substantially equivalent" is intended to mean a temperature the same as the equilibrium surface temperature within a few degrees, for example, within about five Centigrade degrees of the equilibrium surface temperature. Equilibrium surface temperature of the coated layer is the temperature that the surface of the coated layer assumes under steady state conditions of heat transfer following evaporative cooling in the coating zone where heat lost from the coated layer due to evaporation substantially equals heat input to the coated layer from all sources, for example, by conduction from the support, by convection and radiation from the surrounding atmosphere, and so forth.

DESCRIPTION OF THE PREFERRED EMBODIMENTS

Figure 1:
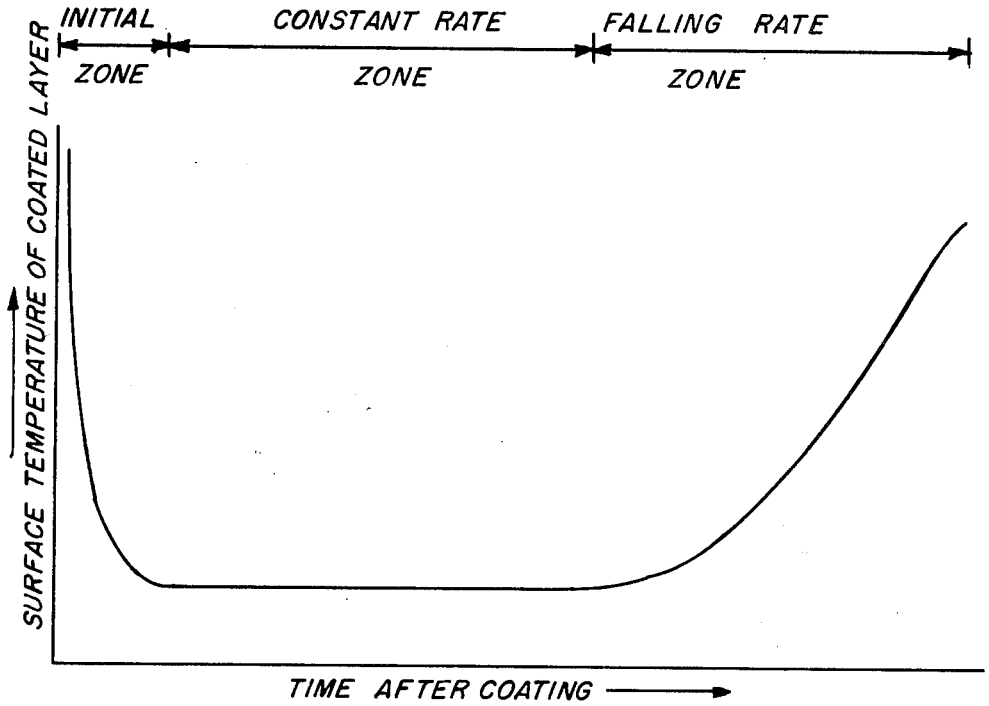
FIG. 1 is a plot of the relationship between the surface temperature of the coated layer in the method of this invention and time elapsed after coating.

The method of this invention is applicable to any coating composition comprising a film-forming material in a liquid vehicle. Thus, for example, the coating composition can be a solution, suspension, dispersion or emulsion. When such compositions are coated, evaporation of the liquid vehicle from the coated layer takes place and such evaporation begins the instant the composition is applied to the support and the cooling which results from evaporation causes the temperature at the surface of the coated layer to decrease. This cooling is believed to induce convective currents in the coated layer which are a significant factor in contributing to formation of mottle and the method of this invention functions to minimize such convective currents and, accordingly, is applicable to the coating of any coating composition from which evaporation of a liquid vehicle occurs.

A significant reduction in mottle can be achieved by the method of this invention in coating any film-forming material or mixture of film-forming material which can be incorporated in a coating composition which comprises a liquid vehicle. It is particularly advantageous in the coating of solutions of polymeric resins in organic solvents because such solvents are often relatively volatile in nature and, in consequence, the degree to which evaporative cooling takes place is very great. Among the numerous examples of film-forming materials with which the invention can be advantageously employed, the following polymers are representative: acetals, acrylics, acetates, cellulosics, fluorocarbons, amides, ethers, carbonates, esters, styrenes, urethanes, sulfones, gelatins, and the like. The polymers can be homopolymers or they can be copolymers formed from two or more monomers. Liquid vehicles for use in the coating composition can be chosen from a wide range of suitable materials. For example, the coating composition can be an aqueous composition or an organic solution comprising an organic solvent. Typical organic solvents include ketones such as acetone or methyl ethyl ketone, hydrocarbons such as benzene or toluene, alcohols such as methanol or isopropanol, halogenated alkanes such as ethylene dichloride or propylene dichloride, esters such as ethyl acetate or butyl acetate, and the like. Combinations of two or more organic solvents can, of course, be utilized as the liquid vehicle.

The weight percentage of solids in the coating composition can be as high as ninety percent, or more, but will more typically be in the range of about one to about twenty percent by weight. Optimum viscosity for the coating composition will depend on the type of coating apparatus employed and can be as high as 60,000 centipoise, or more, but will more typically be in the range from about 1 to about 1000 centipoise. In addition to the film-forming material and the liquid vehicle, the coating composition can contain various optional ingredients such as pigments, surfactants, viscosity modifiers, leveling agents, antifoaming agents, and so forth. The incorporation of surfactants in the coating composition is advantageous in that they serve to reduce the surface tension of the composition and to reduce the rate of change of surface tension as a function of temperature. Accordingly, there is less force causing fluid motion as a result of temperature difference within the coated layer and, in consequence, a reduced tendency to form mottle.

Coating compositions which present particular difficulty because of their pronounced tendency to form mottle are those in which the liquid vehicle is relatively volatile, and it is with these coating compositions that the method described herein is most useful. In particular, such compositions are those in which the liquid vehicle is an organic solvent having a boiling point at atmospheric pressure in the range from about 40° to about 85° C.

The support which is coated by the method of this invention can be composed of any material whatever, as long as it is a material which can be coated with a liquid coating composition. It will most typically take the form of a sheet material which is coated as a continuous web in a continuous coating process, but could also be in discrete form such as separate sheet carried through the coating zone by a conveyor belt or similar device. Typical examples of supports are polymeric films such as films of polyesters, polyolefins or cellulose esters; metal foils such as aluminum or lead foils; paper; polymer-coated paper such as polyethylene-coated paper; and laminates comprised of various layers of plastics or of plastic and metal foil.

Any suitable type of coating apparatus can be used in the method of this invention. Thus, for example, the coating composition can be coated by dip coating, air knife coating, roll coating, gravure coating, extrusion coating (for example as described in U.S. Pat. No. 2,681,294), multilayer bead coating (for example as described in U.S. Pat. No. 2,761,791), curtain coating (for example as described in U.S. Pat. Nos. 3,508,497 and 3,632,374), and so forth. The coating method used can be one in which only a single layer is coated or two or more layers can be coated simultaneously. The coating speed is limited only by the limitations of the particular coating equipment employed and can be as high as 1000 feet per minute, or more. Typically, coating speeds of about 50 to about 500 feet per minute would generally be employed in practicing the method described herein. Wet coverage of the coating composition is also a matter of choice and will depend upon many factors such as the type of coating apparatus employed, the characteristics of the coating composition, and the desired thickness of the coated layer after drying. Typically, wet coverages employed in the method of this invention will be in the range of from about 0.01 to about 100 cubic centimeters per square foot of support surface and more usually in the range of from about 0.5 to about 10 cubic centimeters per square foot. In the interests of decreasing the formation of mottle, it can be advantageous to utilize a high percentage of solids in the coating composition to thereby permit coating at a low wet coverage and with a high viscosity. This tends to immobilize the coating composition and thereby to reduce convective flow and minimize the formation of mottle.

Evaporative cooling of the coated layer will typically cause it to reach an equilibrium surface temperature that is substantially below room temperature. To maintain the temperature of the atmosphere in the coating zone, the temperature of the support, and the temperature of the coating composition at a temperature substantially equivalent to such equilibrium surface temperature, any of a wide variety of techniques can be employed to cool the atmosphere in the coating zone, cool the support, and cool the coating composition. Thus, for example the gaseous atmosphere in the coating zone (usually air, although an inert gas atmosphere of nitrogen or other inert gas could be used if desired) can be passed through suitable heat exchangers and air conditioning units to control its temperature and moisture content (so as to prevent moisture condensation on the coated layer). If desired, the coating chamber can be equipped with suitable cooling coils to aid in maintaining the desired temperature control. Fans or blowers for circulating the air of other gas through the coating chamber can be utilized and liquid nitrogen can be introduced into the air supply to provide rapid cooling. Control of the temperature of the support can be achieved by passing it through air conditioned cooling chambers, or over chilled rolls, or by impinging cold air onto it. The coating composition can be maintained at the desired temperature by holding it in jacketed storage vessels, passing it through heat exchangers, or cooling it within the coating apparatus. To facilitate startup and aid in maintaining the desired temperature control, the coating hopper and backing roll located within the coating zone can be equipped with appropriate passageways for circulation of a heat exchange fluid. Insulationn of supply lines and of the coating chamber can also be employed with advantage to aid in maintaining the desired temperature conditions in the coating operation.

As hereinbefore described, the method of this invention comprises maintaining at least two of (1) the temperature of the atmosphere in the coating zone, (2) the temperature of the coating composition at the point where it is coated on the support, and (3) the temperature of the support at the point where the coating composition is applied thereto at a temperature substantially equivalent to the equilibrium surface temperature of the coated layer within the coating zone. Preferably, the method comprises maintaining each of (1), (2) and (3) at a temperature substantially equivalent to such equilibrium surface temperature. Most preferably, the method comprises maintaining each of (1), (2) and (3) at a temperature as nearly the same as such equilibrium surface temprature as can be attained.

Coating by the method of this invention is ordinarily carried out at atmospheric pressure although sub-atmospheric or superatmospheric pressures can also be used if desired. The atmosphere within the coating zone will usually comprise a major proportion of air and a minor proportion of vapor evolved from the coated layer. Addition to the atmosphere in the coating zone of vaporized coating solvent can be made, if desired, in order to decrease the rate of evaporation. Once the coated support leaves the coating zone it enters a drying zone in which drying of the coated layer is carried out by conventional techniques.

The attached FIG. 1 illustrates the variation in temperature of a coated layer with passage of time from the instant the coating composition is applied to the support. In the typical situation, three clearly defined zones are recognized to exist. Initially a large amount of solvent flashes off and there is a rapid temperature drop. This is referred to as the initial zone. When the mass flux reaches a constant rate, evaporative heat losses substantially equal heat gains and the coating is in the constant rate zone where the surface of the coated layer reaches its equilibrium surface temperature. Once solvent diffusion within the coated layer becomes a significant factor in determining the mass flux, the falling rate zone, in which diffusion plays an increasing roll in determining how the coated layer dries, is reached. The duration of the initial zone and the constant rate zone for a coated layer is related to the degree to which thermal gradients are created within the layer.

While applicant does not wish to be bound by any theoretical explanation of the manner in which the invention functions to reduce mottle, it is believed that mottle and related defects occur by convectional flow taking place within the coated layer. Surface tension of a liquid is a function of temperature and thermal gradients in a coated layer, resulting from variations in temperature between coating composition, support and environment, cause surface tension gradients which induce convectional flow and cause mottle and related defects. The method of this invention minimizes such thermal gradients and thereby reduces the formation of mottle and related defects such as streaks and lines.

Figure 2:
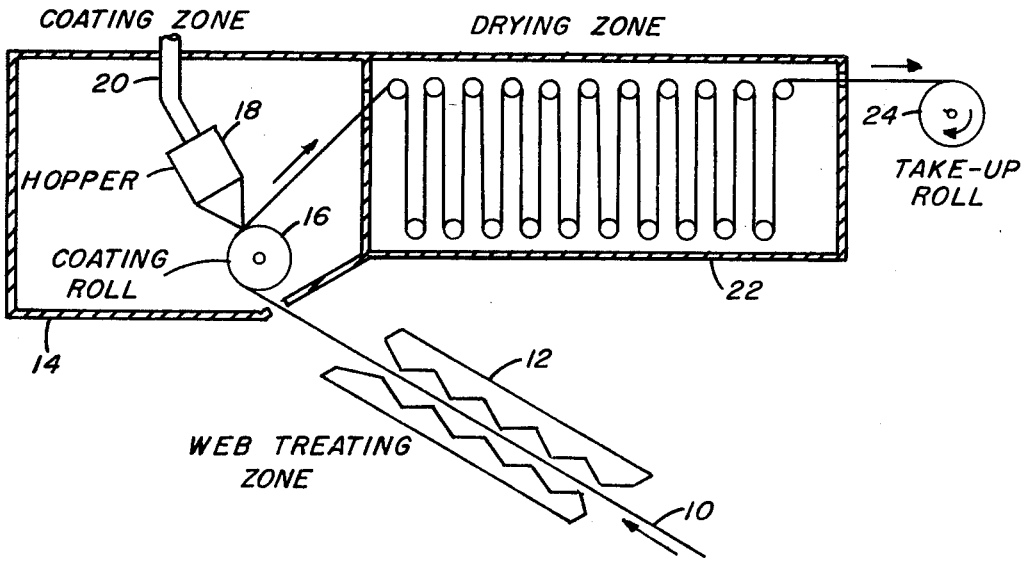
FIG. 2 is a schematic illustration of coating apparatus which is suitable for carrying out the method of this invention.

FIG. 2 is a schematic illustration of a coating line adapted to carry out the improved coating method of this invention. As shown in FIG. 2, a web 10 of synthetic polymer is passed through a treating chamber 12, in which cool air impinges thereon to lower the temperature of web 10 to a desired level. After leaving treating chamber 12, web 10 passes directly into coating chamber 14 in which it passes over coating roll 16 and under coating hopper 18 which is equipped with inlet pipe 20 which is connected to a source (not shown) of coating composition. Coating hopper 18 functions to apply a thin layer of coating compositionn to web 10. The atmosphere within coating chamber 14 is maintained at the desired level by suitable temperature controlling means (not shown) and the coating composition fed to coating hopper 18 is brought to the desired temperature level by means of a suitable heat exchanger (not shown). After being coated within coating chamber 14, web 10 passes directly into drying chamber 22 where it is passed in a series of loops over appropriately spaced rollers and then exists from drying chamber 22 and is wound on take-up roll 24.

The invention is further illustrated by the following examples of its practice.

EXAMPLE 1

A polyethylene terephthalate film was coated on a coating line similar to that illustrated in FIG. 2 herein at a web speed of 150 feet per minute. The coating composition was composed of 5.5% by weight pentamethylene bis-p-phenylene diacrylate — co — azelate (38:62) copolymer, 1.0% by weight carbon black, and 0.01% by weight dimethyl polysiloxane polyether surfactant, with the balance being ethylene dichloride solvent. Dry air was circulated through the coating chamber to remove solvent evolved from the coated layer. Three tests were conducted utilizing different temperatures for the atmosphere in the coating chamber and with different temperatures of the web and coating composition at the point of application of the coating composition to the web. Control of the temperature of the coating composition was achieved by passing it through a heat exchanger, while the temperature of the web was controlled by impinging air of the appropriate temperature upon it in the web treating zone. In each test, drying of the coated layer in the drying zone was carried out in the same manner and the dried layer was examined visually for the presence of mottle and rated on a numerical rating scale in which 10 represents severe mottle, 1 represents no detectable mottle, and values between 1 and 10 represent increasing degrees of mottle. The conditions used and results obtained are summarized in the following table:

| Test No. | Temperature of Atmosphere (° C) | Temperature of Web (° C) | Temperature of Coating Composition (° C) | Equilibrium Surface Temperature (° C) | Degree of Mottle |
|---|---|---|---|---|---|
| 1-A | 27 | 27 | 26 | 15 | 10 |
| 1-B | 13 | 18 | 17 | 13 | 5 |
| 1-C | 13 | 18 | 14 | 11 | 3 |

In the above table, the temperatures of the web and coating composition refer to the temperatures existing at the point where the coating composition is coated on the web. The results of these tests indicate that when at least two of (1) the temperature of the atmosphere in the coating zone, (2) the temperature of the web and (3) the temperature of the coating composition are maintained at a level substantially equivalent to the equilibrium surface temperature of the coated layer, as was done in tests 1-B and 1-C, the degree to which mottle is formed in the coated layer is significantly reduced.

EXAMPLE 2

A polyethylene terephthalate film was coated on a coating line similar to that illustrated in FIG. 2 herein at a web speed of 225 feet per minute. The coating composition was composed of 9.4% by weight polymethyl methacrylate, 2.1% by weight carbon black, 8.0% by weight acetone and 80.5% by weight methyl ethyl ketone. Three tests were conducted in which the temperature of the atmosphere in the coating zone, the temperature of the web, and the temperature of the coating solution were maintained at different levels by means of the procedures described in Example 1. Drying of the coated layer in the drying zone was carried out in the same manner in each test. The conditions used and results obtained are summarized in the following table:

| Test No. | Temperature of Atmosphere (° C) | Temperature of Web (° C) | Temperature of Coating Composition (° C) | Equilibrium Surface Temperature (° C) | Degree of Mottle |
|---|---|---|---|---|---|
| 2-A | 24 | 27 | 29 | 16 | 10 |
| 2-B | 16 | 18 | 20 | 14 | 7 |
| 2-C | 14 | 18 | 14 | 12 | 4 |

The results of these tests indicate that when at least two of (1) the temperature of the atmosphere in the coating zone, (2) the temperature of the web and (3) the temperature of the coating composition are maintained at a level substantially equivalent to the equilibrium surface temperature of the coated layer, as was done in tests 2-B and 2-C, the degree to which mottle is formed in the coated layer is significantly reduced.

EXAMPLE 3

A web of polyethylene-coated paper was coated on a coating line similar to that illustrated in FIG. 2 herein at a web speed of 150 feet per minute. The coating composition was an aqueous solution with a total solids content of 62.5 percent containing 4.5% by weight of the sodium salt of poly(ethyl acrylate-co-acrylic acid), 1.5% by weight of the sodium salt of polycarboxylic acid, 56.5% by weight of lead oxide ($Pb_3O_4$), 1.0% by weight of isopropyl alcohol and 36.5% by weight of water. Three tests were conducted in which the temperature of the atmosphere in the coating zone, the temperature of the web, and the temperature of the coating solution were maintained at different levels by means of the procedures described in Example 1. Drying of the coated layer in the drying zone was carried out in the same manner in each test. The conditions used and results obtained are summarized in the following table:

| Test No. | Temperature of Atmosphere (° C) | Temperature of Web (° C) | Temperature of Coating Composition (° C) | Equilibrium Surface Temperature (° C) | Degree of Mottle |
|---|---|---|---|---|---|
| 3-A | 24 | 27 | 32 | 16 | 10 |
| 3-B | 18 | 27 | 18 | 13 | 3 |
| 3-C | 18 | 18 | 18 | 13 | 2 |

The results of these tests indicate that when at least two of (1) the temperature of the atmosphere in the coating zone, (2) the temperature of the web and (3) the temperature of the coating composition are maintained at a level substantially equivalent to the equilibrium surface temperature of the coated layer, as was done in tests 3-B and 3-C, the degree to which mottle is formed in the coated layer is significantly reduced.

As shown by the Examples, the method of this invention provides a substantial reduction in mottle formation in coated layers with both organic and aqueous coating compositions. It has also been found to significantly reduce associated coating defects such as lines and streaks. The method is useful in any coating process where a film-forming material is coated from a coating composition containing a liquid vehicle and mottle in the coated product is a problem. However, it provides particular advantage in coating a very thin layer of coating composition onto a continuous moving flexible web at a high speed. It is particularly useful in the manufacture of photographic products since the formation of mottle in such products, even to a relatively slight extent, can be a very serious problem which results in the waste of much valuable material as scrap because of its inability to meet the exacting specifications which apply. In particular, the method of this invention is useful in the manufacture of photographic film base which is formed by casting a cellulose ester dope on a wheel or belt and stripping off the film after drying. It is also useful in the coating of silver halide emulsions, or other radiation-sensitive compositions, in the manufacture of sensitized photographic films and photographic papers as well as in the coating of other layers which are often included in photographic elements such as subbing layers, antihalation layers, antistatic layers, anticurl layers, filter layers, protective overcoat layers, and so forth. Other products in whose manufacture the invention is especially useful include intensifying screens used with radiographic image-recording elements, such as the screens described in U.S. Pat. No. 3,737,313, and photosensitive elements for use in image transfer processes, such as the elements described in U.S. Pat. No. 3,671,240.

The invention has been described in detail with particular reference to preferred embodiments thereof, but it will be understood that variations and modifications can be effected within the spirit and scope of the invention.

I claim:

1. In a method of coating a support with a coating composition comprising a film-forming material in an evaparable liquid vehicle in which said support is coated with a layer of said coating composition and said coated layer is dried, coating of said layer taking place within a coating zone containing a gaseous atmosphere and evaporation of said liquid vehicle occuring within said coating zone to thereby cause the temperature of the surface of said coated layer to decrease, the improvement which comprises maintaining at least two of (1) the temperature of the atmosphere within said coating zone, (2) the temperature of said support at the point where said coating composition is applied thereto, and (3) the temperature of said coating composition at the point where it is applied to said support, at a temperature which is substantially equivalent to the equilibrium surface temperature of said coated layer within said coating zone, said equilibrium temperature being the temperature assumed by the surface of said coated layer under steady state conditions of heat transfer following evaporative cooling of said layer in said zone, whereby the formation of mottle in said coated layer is reduced.

2. In a method of coating a support with a coating composition comprising a film-forming material in an evaporable liquid vehicle in which said support is coated with a layer of said coating composition and said coated layer is dried, coating of said layer taking place within a coating zone containing a gaseous atmosphere and evaporation of said liquid vehicle occuring within said coating zone to thereby cause the temperature of the surface of said coated layer to decrease, the improvement which comprises maintaining each of (1) the temperature of the atmosphere within said coating zone, (2) the temperature of said support at the point where said coating composition is applied thereto, and (3) the temperature of said coating composition at the point where it is applied to said support, at a temperature which is substantially equivalent to the equilibrium surface temperature of said coated layer within said coating zone, said equilibrium temperature being the temperature assumed by the surface of said coated layer under steady state conditions of heat transfer following evaporative cooling of said layer in said zone, whereby the formation of mottle in said coated layer is reduced.

3. The method of claim 1 wherein said film-forming material is a polymeric resin and said evaporable liquid is an organic solvent, said resin being dissolved in said solvent.

4. The method of claim 3 wherein said coating composition additionally contains a pigment.

5. The method of claim 4 wherein said coating composition additionally contains a surfactant.

6. The method of claim 1 wherein said film-forming material is a polymeric resin and said evaporable liquid is an organic solvent having a boiling point at atmospheric pressure of from about 40° to about 85° C said resin being dissolved in said solvent.

7. The method of claim 1 wherein said film-forming material is a cellulose ester and said evaporable liquid is acetone, said ester being dissolved in said acetone.

8. The method of claim 1 wherein said film-forming material is a cellulose ester and said evaporable liquid is methyl ethyl ketone, said ester being dissolved in said ketone.

9. The method of claim 1 wherein said support is a web of synthetic organic polymeric material.

10. The method of claim 1 wherein said support is a polyethylene film.

11. The method of claim 1 wherein said support is a polyethylene terephthalate film.

12. The method of claim 1 wherein said support is a web of polyethylene-coated paper.

13. The method of claim 1 wherein said film-forming material is an acrylic polymer.

14. The method of claim 1 wherein said coating composition is coated on said support at a wet coverage of from about 0.01 to about 100 cubic centimeters per square foot of support surface.

15. The method of claim 1 wherein said coating composition is coated on said support at a wet coverage of from about 0.5 to about 10 cubic centimeters per square foot of support surface.

16. The method of claim 1 wherein said support is a web which is advanced through said coating zone at a speed of from about 50 to about 500 feet per minute.

* * * * *